US008656824B2

(12) United States Patent
Johansson

(10) Patent No.: US 8,656,824 B2
(45) Date of Patent: Feb. 25, 2014

(54) SHELL DESIGNED FOR SECURING IN A MORTAR AND MORTAR DESIGNED FOR SUCH A SHELL

(75) Inventor: Nils Johansson, Karlskoga (SE)

(73) Assignee: BAE Systems Bofors AB, Karlskoga (SE)

( * ) Notice: Subject to any disclaimer, the term of this patent is extended or adjusted under 35 U.S.C. 154(b) by 36 days.

(21) Appl. No.: 12/745,017

(22) PCT Filed: Oct. 29, 2008

(86) PCT No.: PCT/SE2008/000612

§ 371 (c)(1),
(2), (4) Date: May 27, 2010

(87) PCT Pub. No.: WO2009/070076

PCT Pub. Date: Jun. 4, 2009

(65) Prior Publication Data

US 2010/0300321 A1 Dec. 2, 2010

(30) Foreign Application Priority Data

Nov. 30, 2007 (SE) ..... 0702645

(51) Int. Cl.
*F41A 9/39* (2006.01)

(52) U.S. Cl.
USPC ..... 89/47; 89/26; 89/40.02

(58) Field of Classification Search
USPC ..... 89/26, 24, 19, 20.2, 20.4, 21, 1.3, 47, 89/40.02
See application file for complete search history.

(56) References Cited

U.S. PATENT DOCUMENTS

| | | | | | |
|---|---|---|---|---|---|
| 1,602,037 | A | * | 10/1926 | Mixsell | 102/374 |
| 2,383,053 | A | * | 8/1945 | Fanger et al. | 102/372 |
| 2,472,111 | A | * | 6/1949 | Kroeger et al. | 89/1.704 |
| 2,473,555 | A | * | 6/1949 | Weiss | 89/26 |
| 2,733,639 | A | * | 2/1956 | Musser | 89/1.704 |
| 2,786,415 | A | | 3/1957 | Alderson | |
| 3,754,726 | A | | 8/1973 | Rusbach | |
| 4,569,288 | A | * | 2/1986 | Grelle et al. | 102/466 |

(Continued)

FOREIGN PATENT DOCUMENTS

| | | | |
|---|---|---|---|
| DE | 19530919 | A1 | 2/1997 |
| GB | 1452778 | A | 10/1976 |
| GB | 2260390 | A | 4/1993 |

OTHER PUBLICATIONS

Extended European Search Report in European Application 08 853 578.6 dated Apr. 9, 2013.

*Primary Examiner* — Stephen M Johnson
(74) *Attorney, Agent, or Firm* — Novak Druce Connolly Bove + Quigg LLP

(57) ABSTRACT

The invention relates to a shell (1) intended for firing from a weapon (6), preferably a mortar weapon (6), the shell (1) being designed for securing the shell (1) in a mortar weapon (6) in order thereby to prevent movement of the shell (1) when adjusting the angle of elevation of the weapon (6). According to the invention this is achieved in that the shell (1) comprises a locking part (19, 28, 37), the locking part (19, 28, 37) forming an integral part of the shell (1) and being designed so that the shell (1) after ramming home is locked to a corresponding securing part (19) in the mortar (6). The invention also relates to a mortar (6) intended for firing said shell (1), the mortar (6) being characterized in that the mortar (6) comprises a corresponding securing part (19) for locking the shell (1).

10 Claims, 5 Drawing Sheets

(56) References Cited

U.S. PATENT DOCUMENTS 4,763,577 A * 8/1988 Romer et al. ..... 102/431
5,503,080 A 4/1996 Goward et al.
5,677,507 A 10/1997 Becker et al.
2004/0107857 A1 * 6/2004 Kuru et al. ..... 102/293

* cited by examiner

SHELL DESIGNED FOR SECURING IN A MORTAR AND MORTAR DESIGNED FOR SUCH A SHELL

CROSS REFERENCE TO RELATED APPLICATIONS

This application is a National Phase filing under 35 U.S.C. §371 of PCT/SE2008/000612 filed on Oct. 29, 2008; and this application claims priority to Application No. 0702645-3 filed in Sweden on Nov. 30, 2007 under 35 U.S.C. §119; the entire contents of all are hereby incorporated by reference.

The present invention relates to a shell intended for firing from a weapon, preferably a mortar weapon, the shell being designed for locking in a mortar to prevent movement of the shell when adjusting the angle of elevation of the mortar prior to firing. The invention also relates to a mortar weapon designed for firing said type of shell and a system comprising said shell and mortar.

BACKGROUND OF THE INVENTION

Conventional mortar weapons (also referred to as mortars) and mortar ammunition has looked pretty much the same since the days of the First World War. Conventional mortars are not especially suited to mounting on vehicles. Where installed on vehicles extensive manual handling is required, both of the mortar by redeploying vehicles and of the shell by changing the number of charges. It is necessary either to sacrifice armour protection and to load the mortar manually from open hatches, or to design complicated loading apparatus which moves shells from the inside of the vehicle to the muzzle of the mortar barrel. A further problem is that the shell lies loosely in the barrel, which means that the mortar can only be fired with a high angle of elevation. If attempts are made to tip the mortar, that is to say to lower the barrel below a certain angle of elevation, there is a great risk that the shell will shift or slide out of the barrel.

Devices to prevent the shell shifting prior to firing, for example when adjusting the angle of elevation of the barrel, have long been known. GB 2 260 390 A discloses and describes a device for locking a shell. The locking device consists of a locking plate and snap fastening. The locking device is fixed to the rear part of the shell, behind the fins of the shell, following which the shell is rammed home into the weapon. The locking plate is disc-shaped and has an outside diameter greater than the inside diameter of the barrel. When ramming the shell home in the barrel the locking plate will be rammed home against a shoulder, which is formed due to the fact that the breech opening diameter of the barrel has been made greater than the remaining diameter of the barrel. The shell is thereby fixed in a specific position inside the barrel. In firing, the locking element is torn off the shell and remains in the barrel. Before the mortar can be reloaded the locking element must be taken care of, either manually or with the aid of a special tool. Locking elements therefore entail a further component that has to be handled as part of the weapon logistics system.

The component must be transported, handled by the ammunition handling system, fitted to the shell, removed from the barrel before the next round can be rammed home, sorted out as scrap and assigned for destruction or reuse. Due to the high pressure and temperature that occur in firing, there is often a risk of the locking element being burned onto or otherwise adhering to the to the breech opening, which in the worst case can lead to fracture of the barrel. In order to cope with the burnt-on component or residues of components, special tools are required, which represent extra equipment in the weapons system. Handling the locking element therefore entails a slower and more complicated weapons system, in which the risk of barrel fracture is great owing to the locking element.

OBJECT AND CHARACTERISTICS OF THE INVENTION

A first object of the present invention is to provide a shell, which is intended for locking in a mortar to prevent movements of the shell when adjusting the angle of elevation of the barrel prior to firing, without the need to arrange any additional locking components on the shell.

A second object of the invention is to provide a mortar which is designed for securing said shell without the need to arrange any additional securing components in the mortar.

A third object of the invention is to provide a shell which is designed for locking in a mortar, which shell will not give rise to any loose parts in the mortar when firing A fourth object of the invention is to provide a shell for locking, which is simple and inexpensive, and which does not adversely affect the performance of the shell.

A fifth object of the invention is to provide a system for firing a shell, the system comprising said shell and mortar.

Said objects and other objects not enumerated here are satisfactorily achieved within the scope of the present independent patent claims. Embodiments of the invention are specified in the dependent patent claims.

The invention has therefore provided a shell designed for locking in a mortar in order to prevent movements of the shell prior to firing, without the need to arrange any additional components on the shell.

According to the invention a mortar has also been provided, which is designed for securing said shell without the need to arrange any additional components in the mortar.

According to the invention a shell has furthermore been provided for locking in the mortar, the shell preventing loose parts remaining in the barrel after firing and the shell being simple and inexpensive, and not adversely affecting the performance of the shell.

Finally, according to the invention a system for firing a shell has been provided, the system comprising said shell and mortar.

The essential characteristic of the shell according to the invention is that the shell comprises a locking part, the locking part forming an integral part of the shell and the locking part being designed so that the shell, after ramming home in the mortar, is locked to a corresponding securing device arranged in the mortar.

According to further aspects of the shell according to the invention:

- the locking part is entirely or partially deformable and the locking part is releasable in response to a force acting on the shell in the firing direction A of the shell
- the locking part is composed of a metal material
- the locking part is composed of a plastic
- the shell comprises a rear end and the locking part is an integral part of the rear end and formed as an end flange
- the end flange comprises a mechanically weakened section
- the shell comprises fixed stabilizer fins and the locking part is an integral of the fixed stabilizer fins and takes the form of locking heels
- the locking heels comprise a mechanically weakened section the shell comprises fixed stabilizer fins, the fixed stabilizer fins being enclosed by a tubular section and the locking part being an integral part of the tubular section and taking the form of a tubular flange with a radially projecting part the tubular flange comprises a mechanically weakened section.

The essential characteristic of the mortar according to the invention is that the mortar comprises a securing device for securing the shell and a breech closure comprising a contact base, and that the contact base comprises a securing part comprising at least two securing heels for securing the shell.

According to further aspects of the mortar according to the invention:

the mortar comprises a breech closure, the breech closure comprising a contact base and the contact base comprising a securing part the securing part comprises securing heels arranged on the securing part of the contact rod the securing device comprises a shoulder in the breech opening of the barrel, the shoulder having been formed in that the breech opening diameter of the barrel has been made larger than the remaining inside diameter of the barrel.

The essential characteristic of the system according to the invention for firing a shell according to the invention is that the system comprises said shell and said mortar.

ADVANTAGES AND EFFECTS OF THE INVENTION

The invention proposed above affords several advantages. No additional components are needed for locking a shell in a specific position in a mortar. The locking part constitutes an integral part of the shell. The logistics system of the weapon is simplified, fewer components need to be handled and transported. The ammunition handling system becomes simpler, faster and less expensive. The shell handling when ramming home is simplified, no additional components need to be fitted to the shell or disposed of after firing. The risk of barrel fracture due to loose parts being burnt on inside the barrel is eliminated.

According to the invention the locking part may also afford advantages with regard to the performance of the shell, in that the deformable part of the locking part, the tubular flange, the end flange or the locking heels are deformed and straightened out directly rearwards. Straightening out directly rearwards is reckoned to have a beneficial effect on the stabilization characteristics of the shell, since the part directed rearwards functions as an additional fin.

Further advantages and effects will emerge from a study and consideration of the following detailed description of the invention, including a number of advantageous embodiments thereof, and the figures of the drawings attached. The method and the device according to the invention have been defined in the following patent claims.

DESCRIPTION OF THE DRAWINGS

The invention will be described in more detail below with reference to the drawings attached, in which.

DETAILED DESCRIPTION OF THE INVENTION

Figure 1:
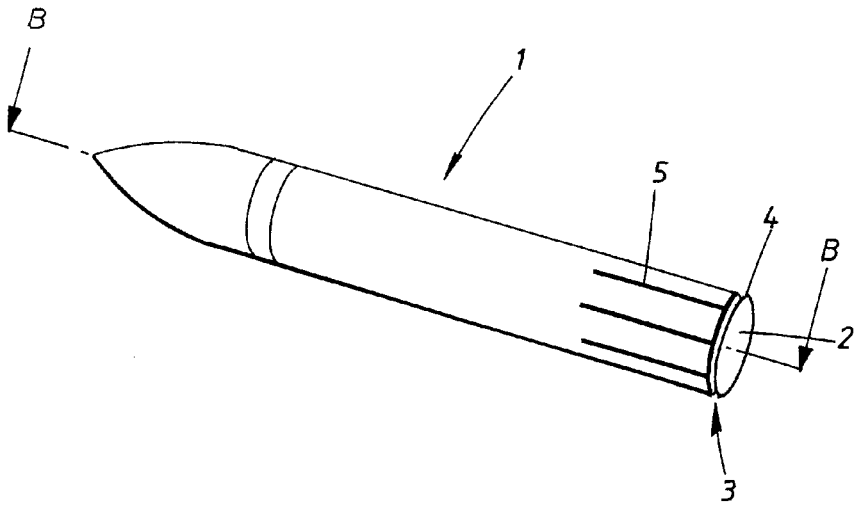
FIG. 1 schematically shows a shell according to the invention, in which the locking part of the shell is arranged in the rear part of the shell FIG. 2 schematically shows a mortar according to the invention in which the shell in FIG. 1 has been prepared for ramming home in the mortar

FIG. 1 shows a preferred embodiment of a shell 1 according to the invention. The shell 1 comprises a locking part 3 arranged at the rear end 2 of the shell 1, the locking part 3 constituting an integral part of the shell 1. The locking part 3 is designed for locking the shell 1 to a corresponding locking part 9, referred to as the securing part 9, arranged in a ramming mechanism of a mortar 6, see FIG. 2. In ramming home the shell 1, the shell 1 is locked in the barrel breech opening of the mortar 6, following which the shell 1 on firing is released by a predefined force acting on the rear end 2 of the shell 1.

Figure 2:
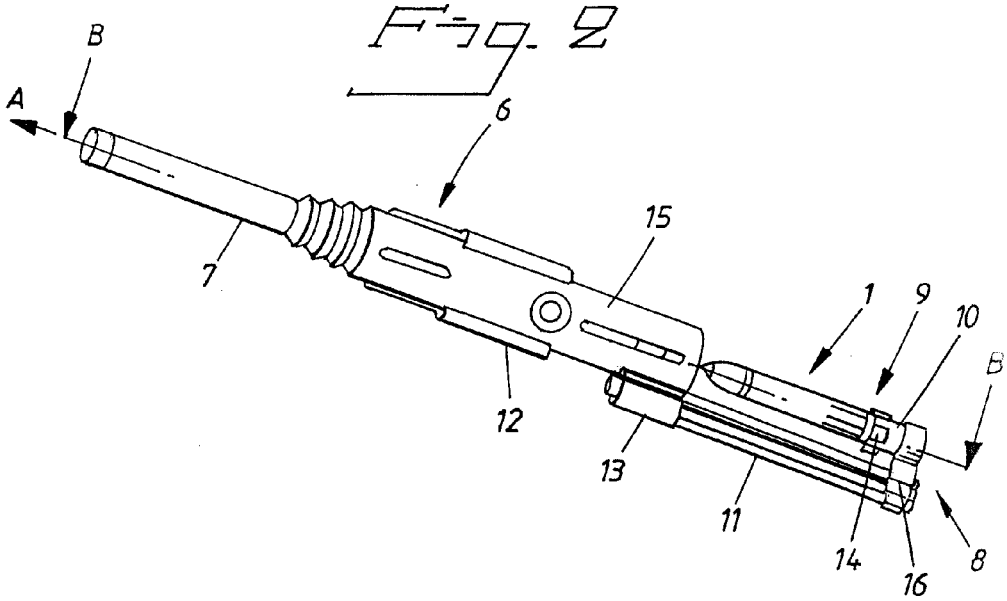

The mortar 6 in FIG. 2 is a motor-driven, automatic breech closure weapon 6, designed for securing the shell 1 according to the embodiment shown in FIG. 1. The mortar 6 is of recoil type and intended for firing shells 1, which can be handled by a mechanical ammunition handling system. The mortar 6 is intended for vehicle-mounting, for mounting on wheeled weapon carriages or for mounting on vessels. The mortar 6 has a breech closure mechanism 8 with a breech closure 10, the movements of which are controlled by an electric servomotor 13 and a digital control system. The servomotor 13, which is mounted directly on the barrel 7, FIG. 2, turns an operating screw, which via a breech closure holder 16 powers the movements of the breech closure 10. The movement of the breech closure holder 16 is controlled by guides 11 and the operating screw of the servomotor 13 and locks the breech closure 10 directly in the rear part of the barrel 7. The breech closure holder 16 has a locking device for locking the breech closure 10 in the barrel 7, the locking device comprising multiple locking blocks 14 arranged on the breech closure 10 and a corresponding number of matching locking grooves in the rear part of the barrel 7. Locking is effected by the servomotor 13 and the operating screw turning the breech closure 10, so that the locking blocks 14 are locked in the locking grooves.

Figure 3A:
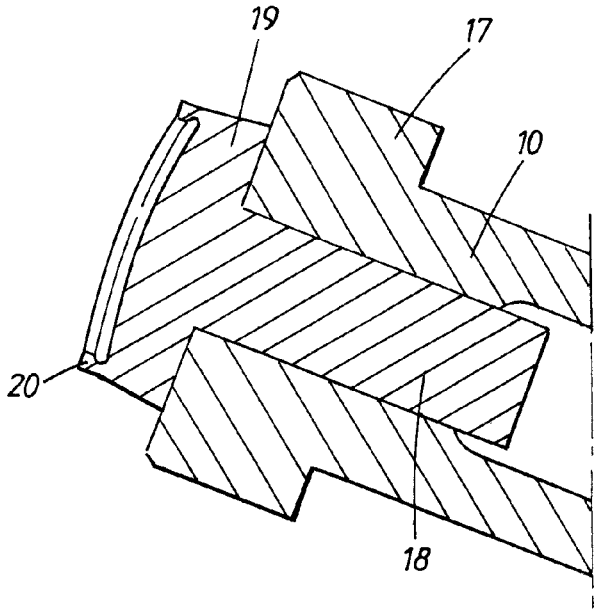
FIG. 3*a* shows a partial enlargement of the securing part of the mortar in FIG. 2
Figure 3B:
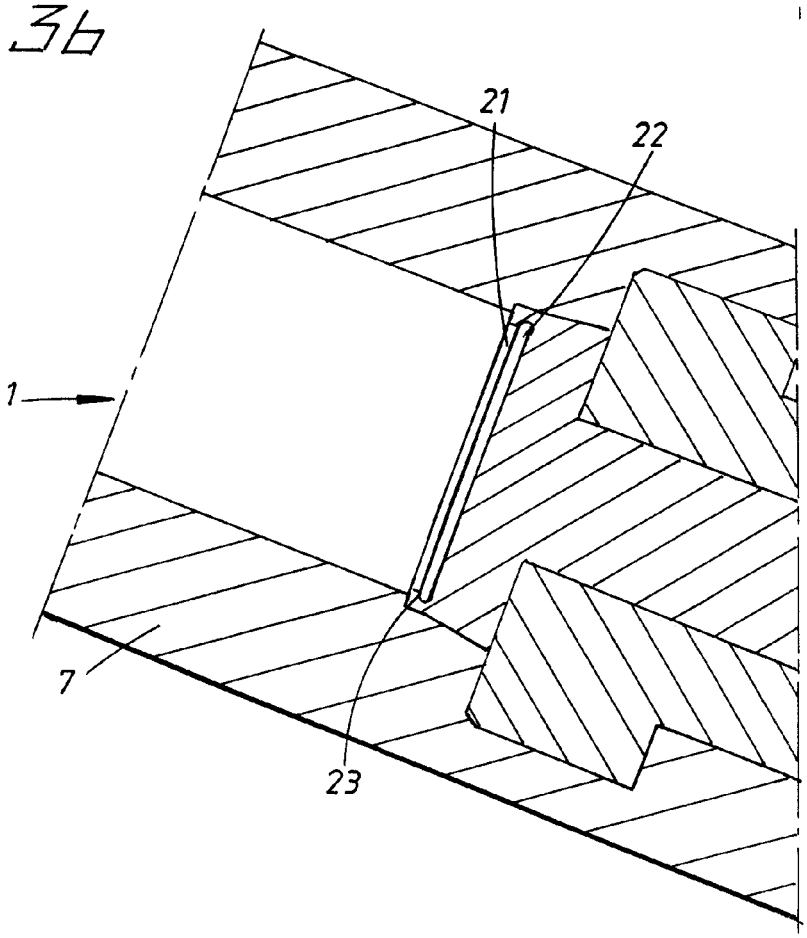
FIG. 3*b* shows the shell in FIG. 1 locked to the securing part of the mortar after ramming home in the mortar
Figure 4A:
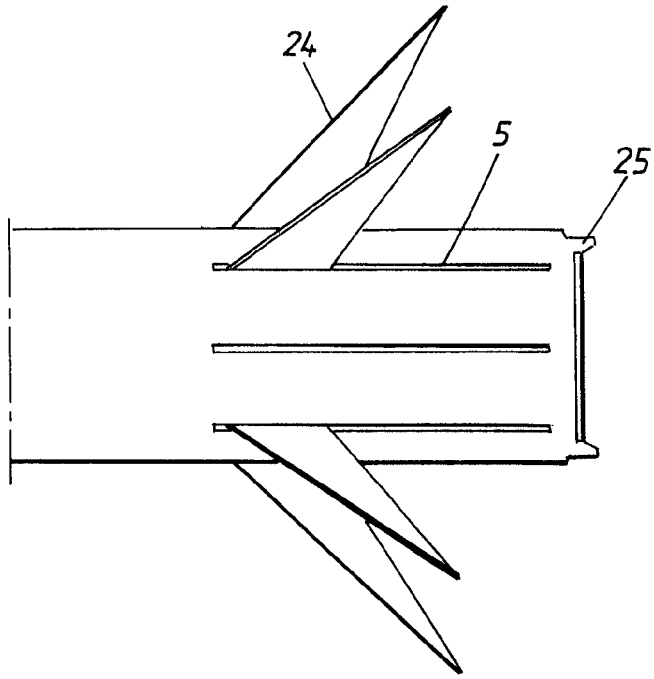
FIG. 4*a* shows the rear part of the shell in FIG. 1 after firing, when the stabilizer fins of the shell are deployed and a part of the tubular flange has been deformed and has straightened out rearwards
Figure 4B:
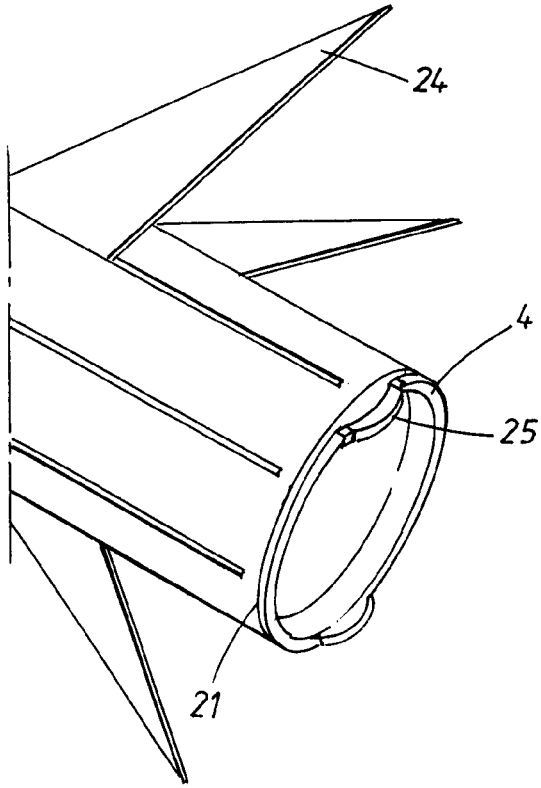
FIG. 4*b* shows the same as in FIG. 4*a* from another perspective FIG. 5*a* schematically shows a second embodiment of the shell according to the invention in which the locking part of the shell is designed as a tubular flange

As can be seen from FIGS. 3*a* and 3*b*, contact base 18 (also referred to as the contact rod 18) is arranged in the breech closure 10, against which contact base 18 the shell 1 is secured by a securing part 19.

Since the shell 1 does not have any charge casing, the contact base 18 of the breech closure 10 is provided with a rubber obturator of the same type as used in screw breech mechanism weapons, not shown. As can be seen from FIG. 2, the recoil mechanism of the mortar 6 comprises two recoil brakes 12, the recoil brakes 12 acting in that they are under a gas pressure. The recoil brakes 12 are arranged in a recoil jacket 15, the recoil jacket 15 being of tubular shape and enclosing the rear part of the barrel. The recoil jacket comprises securing devices for the recoil brakes 12 and for elevation axes of the barrel 7, not shown. The securing devices and controls for the recoil jacket 15 are arranged directly on the barrel 7, not shown. Contact devices for electrical firing of the shell 1 are arranged in the contact base 18 of the breech closure 10, not shown. Also arranged in the front part of the contact base 18 are guide grooves for centering the shell 1.

The shell 1 is rammed into the barrel 7 in that the breech closure holder 16 for the breech closure 10 is advanced by means of the operating screw to a predefined position in the breech opening of the barrel 7. Throughout the ramming process until the shell is rammed in the barrel 7, the shell 1 is secured against the contact base 18 in the breech closure 10. In as much as the contact base 18 does not move in the barrel 7 after ramming home of the shell 1, it can be used for securing the shell 1. The shell 1 is secured by means of a securing part 19, which is arranged on the contact base 18, the securing part 19 forming an integral part of the contact base 18.

When ramming home the shell 1, the shell 1 is locked in a specific position in the barrel 7 in that the periphery of the securing part 19 is locked against a shoulder 23 in the breech opening of the barrel, the shoulder 23 having been formed in that the breech opening diameter of the barrel 7 has been made larger than the remaining inside diameter of the barrel 7.

The securing part 19 in FIGS. 3*a* and 3*b* comprises at least two securing heels 20, the securing heels 20 being designed for locking the shell 1 by way of the locking part 3 of the shell 1, FIGS. 1 and 3*b*. The locking part 3 of the shell 1 consists of a deformable flange 4, the deformable flange 4 having been formed in that a cavity or a groove 21, close to the rear end 2 of the shell 1, has been produced, for example by milling out, the groove running at least one turn around the shell 1. The dimension 22 of the groove is such that it corresponds to the dimension of the securing heels 20. The loading process means that the ammunition handling system of the mortar 6 introduces a shell 1 from the side, so that the securing heels 20 of the securing part 19 are guided into the groove 21 in the shell, thereby locking the shell 6 against the contact base 18 of the breech closure 10.

The flange 4 in FIG. 1 is of deformable design allowing the flange 4 or part of the flange 4 to be deformed and to straighten out rearwards on firing, thereby preventing the flange 4 or parts of the flange 4 being abraded and ending up in the barrel 7. It is preferably only the part of the end 2 comprising the flange 4 that is of deformable design, whilst other parts of the end 2, which are exposed to stresses during firing, are not deformable. The flange 4 can be made more or less deformable in that it is composed of a more or less deformable material and/or by making the flange thicker or thinner. The flange 4 is preferably composed of a deformable metal, such as a steel alloy, for example. Alternatively the flange 4 may be composed of other types of deformable material, such as copper, brass or aluminium or an alloy containing said materials. Plastics and/or composite materials may also be included. The flange 4 can also be designed with a mechanically weakened section to facilitate the deformation.

Because the shell 1 is firmly secured throughout the loading process, it can be rammed home at high speed without the risk of it continuing into the barrel 7 and losing contact with the contact rod 18 and the contact device for electrical firing. A high ramming speed means time-saving and a high rate of fire. In the event of a possible misfire, the shell 1 can easily be drawn out of the barrel 7 by means of the breech closure 10. The mortar 6 is cable of firing at all angles of elevation, even tipping angles. There is no need to rely on the force of gravity to hold the shell 1 in the correct position. Low angles of elevation can be used when the mortar 6 is to be used for directed fire. Conventional mortars are limited to angles of elevation of 45-85 degrees, due to the fact that the shell 1 lies loosely in the barrel.

Figure 5A:
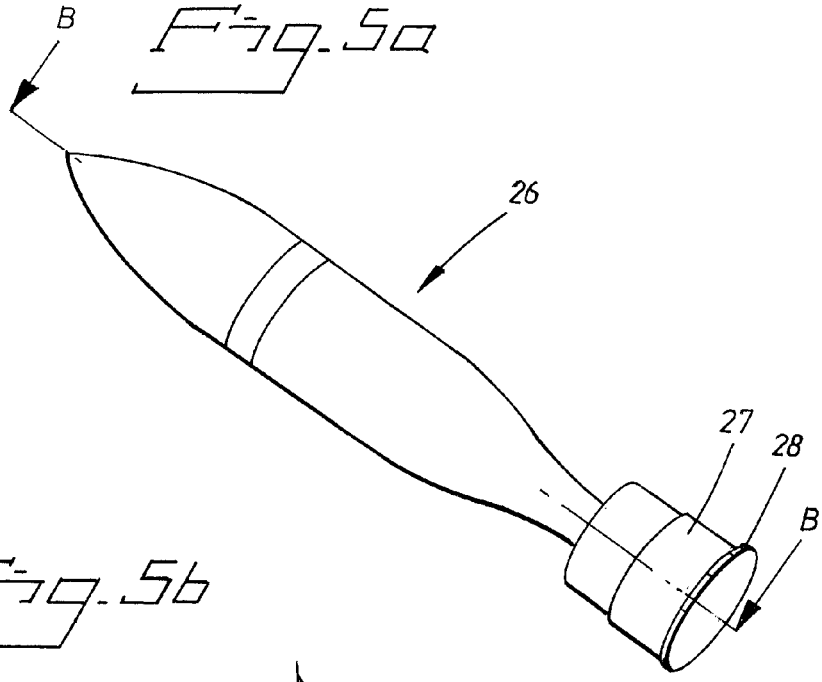
FIG. 5*b* shows a partial enlargement of the tubular flange of the shell in FIG. 5*a*
Figure 5B:
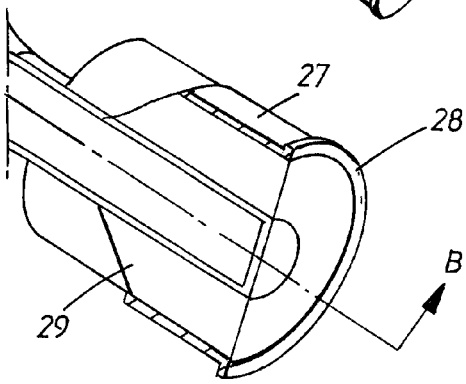
Figure 6:
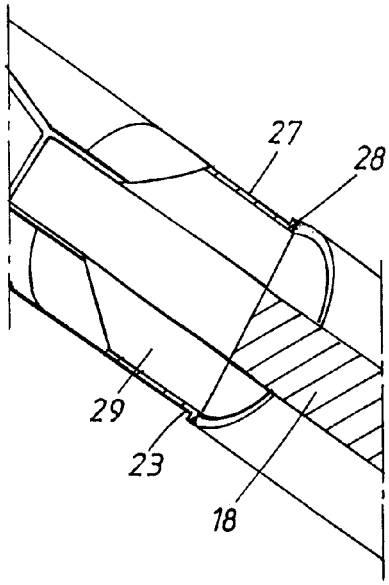
FIG. 6 shows the shell in FIG. 5*a* after ramming home in the mortar

FIGS. 5*a* and 5*b* show an alternative embodiment of a shell 26 according to the invention. The shell 26 is designed with an annular fin section, the annular fin section comprising fixedly mounted fins 29 enclosed by a tubular or cylindrical section 27, the rear part of the tubular or cylindrical section 27 being embodied as a tubular flange 28, also referred to as a tube flange 28, the tube flange 28 comprising a flange part projecting radially outside the shell 26, see FIG. 6. Also arranged in front of the fin section is a propellant charge for firing the shell out of the barrel 7. The tube flange 28 has two functions, firstly to lock the position of the shell 26 in the barrel 7 and secondly to guide the shells in an automatic ammunition handling system in the same way as the casing flange in a conventional cased round. The tube flange 28 in FIGS. 5*a* and 5*b* here forms the locking part of the shell 26 and locks the shell 26 in a specific position in the barrel 7 when the tube flange 28 is rammed home against a shoulder 23 in the breech opening of the barrel 7.

The shell 26 is introduced into the breech opening of the barrel 7 in the firing direction A of the shell by means of the contact base 18, the radially projecting part of the tube flange 28 being pressed against the shoulder 23. In the same way as the end flange 4 in FIG. 1, the tube flange 28 in FIGS. 5*a* and 5*b* is of deformable design, in that it is either composed of a deformable material and/or in that the tube flange 28 has been made thicker or thinner and/or in that it comprises a mechanically weakened section to facilitate the deformation.

When the shell 26 is fired, the tube flange 28 is bent backwards and forms a part of the fin assembly, which allows the shell 26 free passage through the barrel 7, and since the tube flange 28 straightens out it does not present any additional air resistance during the trajectory phase of the shell 26. It is also possible to design the tube flange 28 so that after straightening out the tube flange 28 exerts a stabilizing effect on the flight characteristics of the shell 26.

Figure 7A:
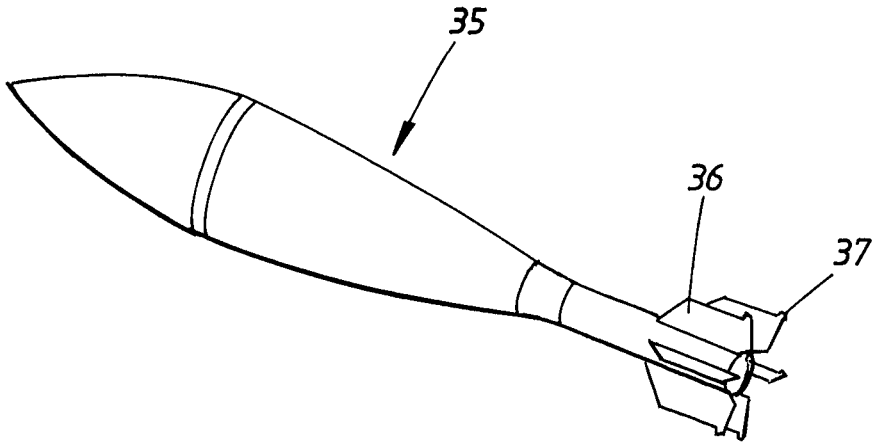
FIG. 7*a* schematically shows a third embodiment of the shell according to the invention in which the locking part of the shell is arranged on stabilizer fins of the shell and consists of locking heels
Figure 7B:
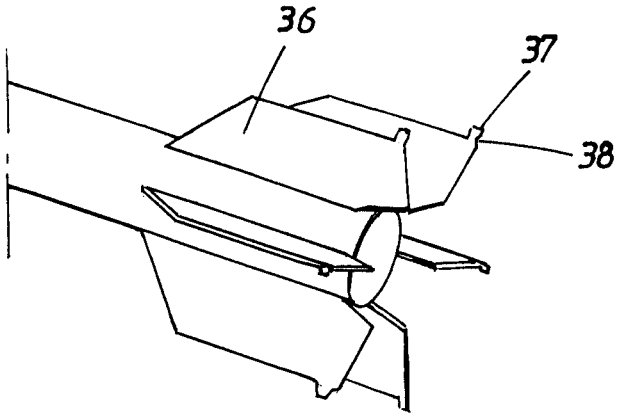
FIG. 7*b* shows a partial enlargement of the rear part of the shell in FIG. 7*a*.

FIGS. 7*a* and 7*b* further show an embodiment of a shell 35 according to the invention. The shell 35 comprises fixed stabilizer fins 36, the fixed stabilizer fins 36 comprising deformable parts, said locking heels 37, the locking heels 37 being arranged on rear vane tips of the stabilizer fins 36. The locking heels 37 are an integral part of the stabilizer fins 36 and comprise a part protruding radially in relation to the longitudinal axis B-B of the shell 35. The locking heels 37 constitute locking parts of the shell 35 and lock the shell 35 in that the radially protruding part of the locking heels 37 is rammed against the shoulder 23 when the contact rod 18 presses the shell 35 into the breech opening of the barrel 7. In the same way as the end flange 4 and the tube flange 28, the locking heels 37 are of deformable design, either in that that they are composed of a deformable material and/or that they have been made thicker or thinner and/or in that they comprise a mechanically weakened section.

The shell is therefore locked in a specific position in the breech opening of the barrel in that a flange or locking heel is pressed against a shoulder in the breech of the barrel and in that the shell is secured against the contact base, which introduces the shell into the barrel. This means that the shell cannot move either forwards or backwards after ramming home. The mortar can be aimed with any angle of elevation, even tipping angles, without the shell shifting. A conventional muzzle-loaded mortar requires angles of elevation of at least approximately 45 degrees in order that the shell will bear against the contact base. The mortar according to the invention affords optimum performance, that is to say the best possible securing of the shell in the barrel and scope for automatic ammunition handling if shells with annular fins are used. Conventional mortar ammunition of standard type may also be used in this type of mortar weapon, however. The sphere of application, however, is limited to high angles of elevation, in which the shell rests against the contact base under its own weight.

ALTERNATIVE EMBODIMENTS

The invention is not limited to the examples shown but may be modified in various ways without departing from the scope of the patent claims. The embodiment of the locking part of the shell and the securing part of the mortar can therefore be modified within the bounds of feasibility, provided that no additional components are added or fitted to the shell and/or in the mortar and that no loose or burnt-on parts remain in the barrel of the mortar after firing.

The invention claimed is:

1. Mortar for firing a shell intended for firing from a weapon, wherein the shell is designed for locking a mortar to prevent movement of the shell when adjusting the angle of elevation of the mortar prior to firing, wherein the shell comprises a locking part, the locking part forming an integral part of the shell and being designed so that the shell, after ramming home in the mortar, is locked to a corresponding securing device arranged in the mortar and wherein the locking part comprises a deformable mechanically weakened section to facilitate deformation of the weakened section, and wherein the mortar comprises a securing device operable to secure the shell and a breech closure comprising a contact base, and the contact base comprises the securing part comprising at least two securing heels operable to secure the shell.

2. Mortar for firing a shell according to claim 1, wherein the securing device comprises a shoulder arranged in the breech opening of the barrel the shoulder having been formed in that the breech opening diameter of the barrel has been made larger than the remaining inside diameter of the barrel.

3. System for firing a shell, wherein the system comprises a shell intended for firing from a weapon, the shell being designed for locking a mortar to prevent movement of the shell when adjusting the angle of elevation of the mortar prior to firing, wherein the shell comprises a locking part, the locking part forming an integral part of the shell and being designed so that the shell, after ramming home in the mortar, is locked to a corresponding securing device arranged in the mortar and wherein the locking part comprises a deformable mechanically weakened section to facilitate deformation of the weakened section and a mortar according to claim 2.

4. System for firing a shell, wherein the system comprises a shell intended for firing from a weapon, the shell being designed for locking a mortar to prevent movement of the shell when adjusting the angle of elevation of the mortar prior to firing, wherein the shell comprises a locking part, the locking part forming an integral part of the shell and being designed so that the shell, after ramming home in the mortar, is locked to a corresponding securing device arranged in the mortar and wherein the locking part comprises a deformable mechanically weakened section to facilitate deformation of the weakened section and a mortar according to claim 1.

5. System for firing a shell according to claim 4, wherein the shell comprises a rear end and the locking part comprises an end flange, the end flange being an integral part of the rear end.

6. System for firing a shell according to claim 4, wherein the shell comprises fixed stabilizer fins and the locking part comprises locking heels, the locking heels being integrally formed with the fixed stabilizer fins.

7. System for firing a shell according to claim 4, wherein the shell comprises fixed stabilizer fins, the fixed stabilizer fins being enclosed by a tubular part, the rear end of the tubular part being formed as a tubular flange.

8. Mortar for firing a shell according to claim 1, wherein the shell comprises a rear end and that the locking part comprises an end flange, the end flange being an integral part of the rear end.

9. Mortar for firing a shell, according to claim 1 wherein the shell comprises fixed stabilizer fins and that the locking part comprises locking heels, the locking heels being integrally formed with the fixed stabilizer fins.

10. Mortar for firing a shell, according to claim 1 wherein the shell comprises fixed stabilizer fins, the fixed stabilizer fins being enclosed by a tubular part, the rear end of the tubular part being formed as a tubular flange.

* * * * *